US010847933B2

(12) United States Patent
Shinba et al.

(10) Patent No.: US 10,847,933 B2
(45) Date of Patent: Nov. 24, 2020

(54) CONNECTOR HOLDER THAT HOLDS AND INTEGRATES PLURALITY OF CONNECTORS

(71) Applicant: KYOCERA Document Solutions Inc., Osaka (JP)

(72) Inventors: Minoru Shinba, Osaka (JP); Masanori Kyogoku, Osaka (JP); Yuichi Sugiyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 1 day.

(21) Appl. No.: 16/388,155

(22) Filed: Apr. 18, 2019

(65) Prior Publication Data

US 2019/0334285 A1 Oct. 31, 2019

(30) Foreign Application Priority Data

Apr. 27, 2018 (JP) ..... 2018-086575

(51) Int. Cl.
*H01R 13/639* (2006.01)
*H01R 13/627* (2006.01)
*H01R 13/518* (2006.01)

(52) U.S. Cl.
CPC ..... *H01R 13/639* (2013.01); *H01R 13/627* (2013.01); *H01R 13/518* (2013.01)

(58) Field of Classification Search
CPC .. H01R 13/639; H01R 13/627; H01R 13/518; H01R 13/506

(Continued)

(56) References Cited

U.S. PATENT DOCUMENTS 3,705,377 A * 12/1972 Hansen ..... H01R 13/518 439/540.1
4,964,817 A * 10/1990 Kanai ..... H01R 13/518 439/701

(Continued)

FOREIGN PATENT DOCUMENTS

CN 102823073 A 12/2012
JP H02-106688 U 8/1990

(Continued)

OTHER PUBLICATIONS

The first office action in CN mailed by SIPO (State Intellectual Property office) dated Apr. 2, 2020 in the corresponding Chinese Patent Application No. 201910312470.4.

*Primary Examiner* — Nguyen Tran
*Assistant Examiner* — Paul D Baillargeon
(74) *Attorney, Agent, or Firm* — IP Business Solutions, LLC

(57) ABSTRACT

A connector holder that holds and integrates a plurality of connectors, the connector holder including a pressing part, side wall parts, and connecting parts. The pressing part is arranged in a center of the connector holder. The side wall parts are respectively disposed on each of both sides with respect to the pressing part at intervals in the array direction of pins of the connectors that the connector holder holds. The connecting parts respectively connect a lower end portion of the pressing part and a lower end portion of each of the side wall parts disposed on the both sides in the array direction. Holding parts are respectively formed on the both sides in the array direction of the pressing part, the holding parts holding the connectors together with the pressing part, the side wall parts, and the connecting parts.

8 Claims, 5 Drawing Sheets

(58) Field of Classification Search
USPC ..... 439/540.1
See application file for complete search history.

(56) References Cited

U.S. PATENT DOCUMENTS

| | | | | |
|---|---|---|---|---|
| 5,281,161 | A * | 1/1994 | Kanai | H01R 12/716 439/357 |
| 7,689,089 | B2 * | 3/2010 | Wagner | H04Q 1/13 385/135 |
| 10,637,178 | B2 * | 4/2020 | Shinba | H01R 24/60 |
| 2012/0309221 | A1 | 12/2012 | Scherer et al. | |

FOREIGN PATENT DOCUMENTS

| | | | |
|---|---|---|---|
| JP | 2014-120483 | A | 6/2014 |
| WO | 2011094656 | A2 | 8/2011 |

* cited by examiner

CONNECTOR HOLDER THAT HOLDS AND INTEGRATES PLURALITY OF CONNECTORS

INCORPORATION BY REFERENCE

This application claims priority to Japanese Patent Application No. 2018-086575 filed on Apr. 27, 2018, the entire contents of which are incorporated by reference herein.

BACKGROUND

The present disclosure relates to a connector holder that holds and integrates a plurality of connectors.

Image forming apparatuses, such as copying machines and multifunction machines, include many basal plates and use a lot of electric wires connecting between basal plates and between the basal plates and other units. Generally, electric wires are connected by connection between a basal plate side connector and an electric wire side connector. Recently, the number of the multi-polarity connectors has increased, and a large number of the electric wire can be connected at a time.

In multi polarizing of the electric wire side connector, a connector holder that uses a pair of connectors each of which has a row of contactors, and receives and holds a connector having two rows of contacts has been suggested.

SUMMARY

A technique improved over the above technique is proposed herein as an aspect of the present disclosure.

A connector holder according to one aspect of the present disclosure is a connector holder that holds and integrates a plurality of connectors, the connector holder including a pressing part, side wall parts, and connecting parts. The pressing part is arranged in a center of the connector holder. The side wall parts are respectively disposed on each of both sides with respect to the pressing part at intervals in the array direction of pins of the connectors that the connector holder holds. The connecting parts respectively connect a lower end portion of the pressing part and a lower end portion of each of the side wall parts disposed on the both sides in the array direction. Holding parts are respectively formed on the both sides in the array direction of the pressing part, the holding parts holding the connectors together with the pressing part, the side wall parts, and the connecting parts.

DETAILED DESCRIPTION

Hereinafter, embodiments of the present disclosure will be detailed with reference to the drawings. In the following embodiments, the same reference number is given to the configuration indicating the same function.

First Embodiment

Figure 1:
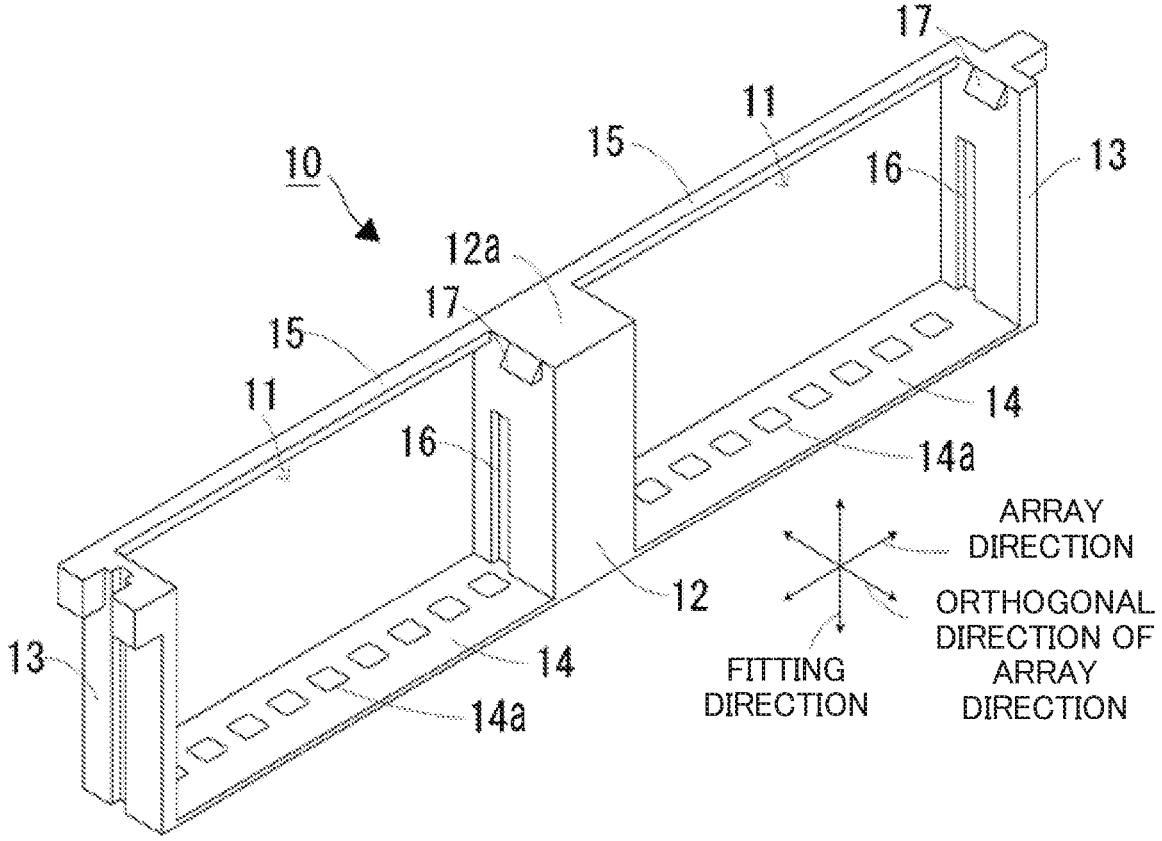
FIG. 1 is a perspective view showing a configuration of a first embodiment of a connector holder according to the present disclosure.
Figure 2A:
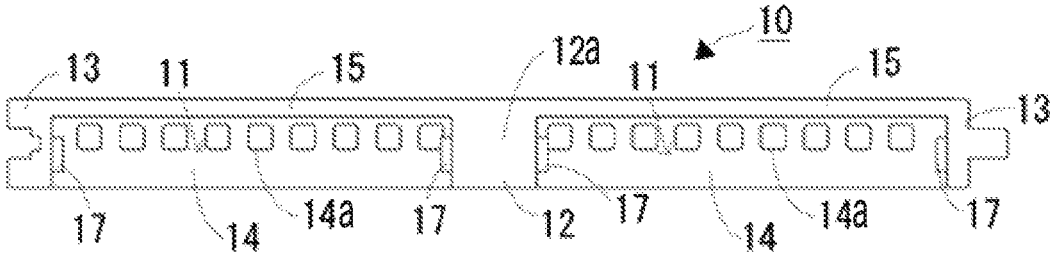
FIG. 2A shows a top view of the connector holder shown in FIG. 1.
Figure 2B:
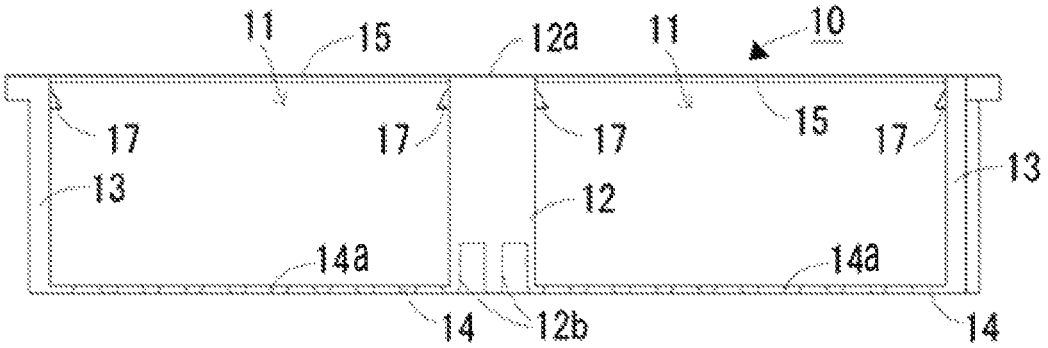
FIG. 2B shows a side view of the connector holder shown in FIG. 1.
Figure 2C:
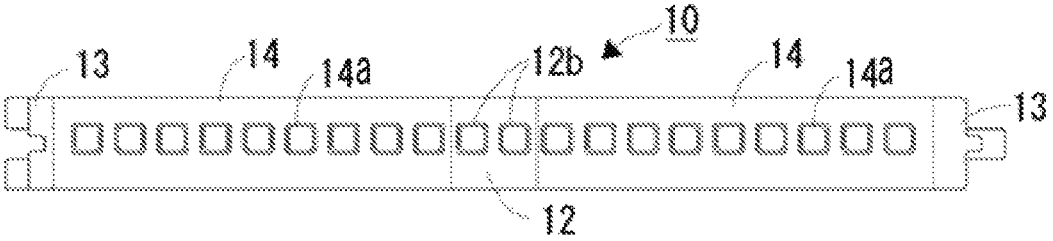
FIG. 2C shows a bottom view of the connector holder shown in FIG. 1.

With reference to FIG. 1 and FIGS. 2A to 2C, a connector holder 10 according to the first embodiment has a holding part 11 at two positions; the holding part 11 holds a 1-row-9-Pin electric wire side connector. By holding and integrating two 1-row-9-Pin electric wire side connectors, an electric wire side connector that fits into a 1-row-20-Pin basal plate side connector is formed. FIG. 2A shows a top view of the connector holder 10 when in viewed from an upstream side in a fitting direction. FIG. 2B shows a side view of the connector holder 10 when in viewed from a direction orthogonal with the fitting direction and with an array direction of the pins (hereinafter simply referred to as the array direction). FIG. 2C shows a bottom view of the connector holder 10 when in viewed from a downstream side in the fitting direction.

The holding parts 11 are respectively formed on both sides in the array direction with respect to the pressing part 12 disposed at the center of the connector holder 10

Side wall parts 13 are respectively disposed on the both sides in the array direction of the pressing part 12 at intervals. A lower end portion of the pressing part 12 and a lower end portion of each of the side wall parts 13 disposed on the both sides in the array direction are respectively connected by bottom face plates 14. The bottom face plates 14 become surfaces that contact the basal plate side connector. The pressing part 12, the side wall parts 13, and the bottom face plates 14 form the holding parts 11 on the both sides in the array direction of the pressing part 12. Connecting bars 15 shown in FIG. 1 and FIGS. 2A, 2B are stick-like members that respectively connect an upper end portion of the pressing part 12 and an upper end portion of each of the side wall parts 13 disposed on the both sides in the array direction, and ensure strength of the connector holder 10.

The pressing part 12, the side wall parts 13, the bottom face plates 14, and the connecting bars 15 are integrated by an insulating material, such as synthetic resin, thereby forming the connector holder 10.

An upper end face of the pressing part 12 is formed into a plane perpendicular to a fitting direction, and functions as a pressing face 12*a*. Accordingly, when being fitted into the basal plate side connector, it becomes possible to press the pressing face 12*a* of the pressing part 12, so that the pressing power can act on sufficiently. No electric wires connected to the electric wire side connector that the holding parts 11 hold are present at the pressing face 12*a* of the pressing part 12, so that applying pressure to the pressing face 12*a* of the pressing part 12 can be easily performed. In addition, by structuring the pressing face 12*a* to have the plane surface, the pressing face 12*a* becomes easy to be handled even with a suction type hand of a robot.

At each surface of the pressing part 12 opposing to the holding parts 11 and each surface of the side wall parts 13 opposing to the holding parts 11, a positioning member 16 and a locking member 17 are provided; the positioning member 16 is formed in accordance with a shape of the electric wire side connector to be held; the locking member 17 is locked to the electric wire side connector that the holding parts 11 held.

The bottom face plates 14 positioned at each of the both sides in the array direction of the pressing part 12 has nine through holes 14*a* formed thereon. The nine through holes 14*a* are respectively formed at positions facing 1-row-9-Pin cavities of the electric wire side connector held by the holding parts 11.

As shown in FIG. 2B and FIG. 2C, two insertion holes 12*b* in one row are formed at a lower end face of the pressing part 12; part of contactors of one row of contactors of the basal plate side connector are inserted into the two insertion holes 12*b* in one row. The two insertion holes 12*b* in one row and two of the nine through holes 14*a* in one row (the cavities of the electric wire side connector) are arrayed in the same pitch with 1-row-20-Pin contactors of the basal plate side connector. Thus, 1-row-20-Pin general purpose products can be used as the basal plate side connector. Among the 1-row-20-Pin contactors of the basal plate side connectors, the contactors that are to be inserted into the two insertion holes 12*b* in one row of the pressing part 12 are originally assigned to contactors not to be used (unused contactors), and are only to be inserted into the insertion holes 12*b*.

Second Embodiment

Figure 3:
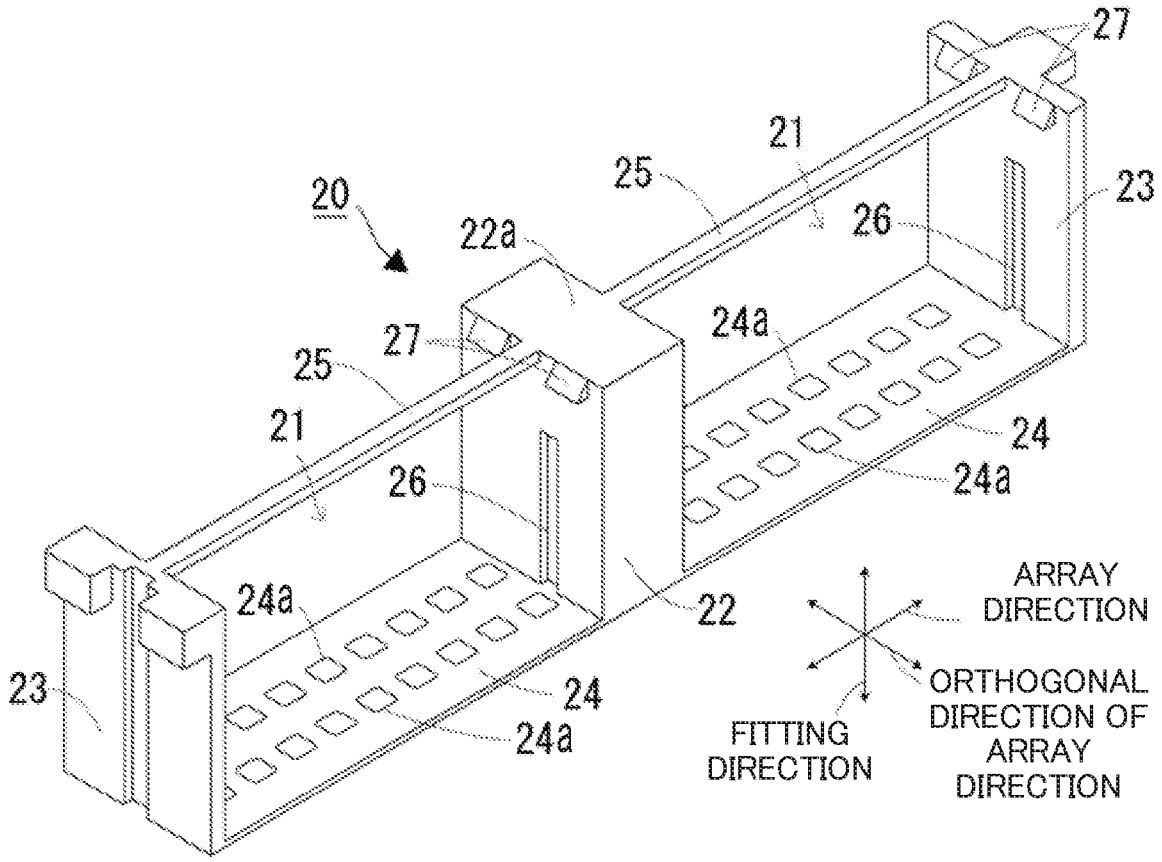
FIG. 3 is a perspective view showing a configuration of a second embodiment of a connector holder according to the present disclosure.
Figure 4A:
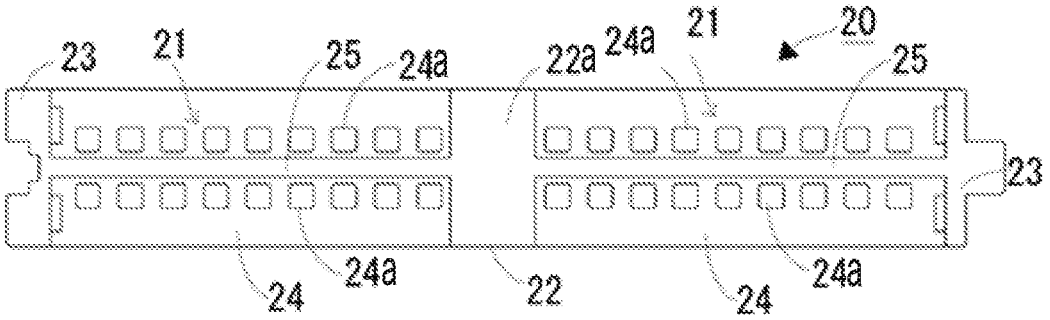
FIG. 4A shows a top view of the connector holder shown in FIG. 1.
Figure 4B:
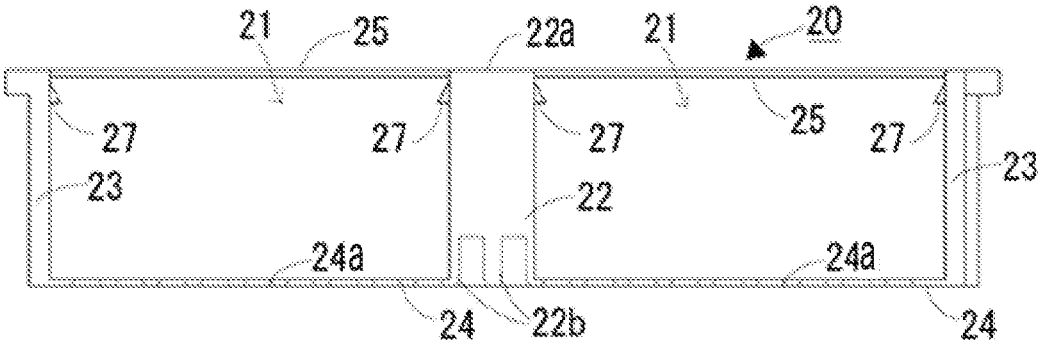
FIG. 4B shows a side view of the connector holder shown in FIG. 1.
Figure 4C:
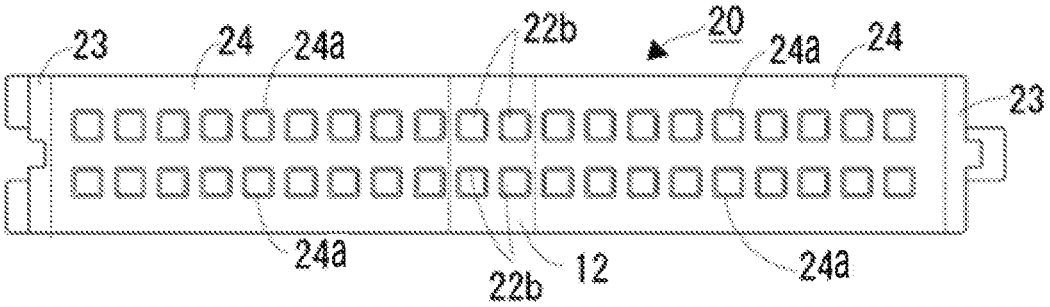
FIG. 4C shows a bottom view of the connector holder shown in FIG. 1.

With reference to FIG. 3 and FIGS. 4A to 4C, a connector holder 20 according to the second embodiment has a holding part 21 at two positions; the holding part 21 holds two 1-row-9-Pin electric wire side connectors. By holding and integrating four 1-row-9-Pin electric wire side connectors, an electric wire side connector that fits into a 2-rows-40-Pin basal plate side connector is formed. FIG. 4A shows a top view of the connector holder 20 when in viewed from the upstream side in the fitting direction. FIG. 4B shows a side view of the connector holder 20 when in viewed from the direction orthogonal with the fitting direction and with the array direction of the pins (hereinafter referred to as the array direction). FIG. 4C shows a bottom view of the connector holder 20 when in viewed from the downstream side in the fitting direction.

The holding parts 21 are respectively formed on both sides in the array direction with respect to the pressing part 22 disposed at the center of the connector holder 20. The holding parts 21 are structured so as to hold two electric wire side connectors in a direction orthogonal with the array direction (hereinafter referred to as the orthogonal direction of the array direction).

Side wall parts 23 are respectively disposed on the both sides in the array direction of the pressing part 22 at intervals. A lower end portion of the pressing part 22 and a lower end portion of each of the side wall parts 23 disposed on the both sides in the array direction are respectively connected by bottom face plates 24. The bottom face plates 24 become surfaces that contact the basal plate side connector. The pressing part 22, the side wall parts 23, and the bottom face plate 24 form the holding parts 21 on the both sides in the array direction of the pressing part 22. Connecting bars 25 shown in FIG. 3 and FIGS. 4A, 4B are stick-like members that respectively connect a center portion in the orthogonal direction of the array direction on the upper end portion of the pressing part 22 and a center portion in the orthogonal direction of the array direction on an upper end portion of each of the side wall parts 23 disposed on the both sides in the array direction, and ensures strength of the connector holder 20.

The pressing part 22, the side wall parts 23, the bottom face plates 24, and the connecting bars 25 are integrated by an insulating material, such as synthetic resin, thereby forming the connector holder 20.

An upper end face of the pressing part 22 is formed into a plane perpendicular to a fitting direction, and functions as a pressing face 12*a*. In addition, the pressing part 22 is integrally structured in which the upper end and the lower end are connected in the vertical direction so that pressing power acting on the pressing face 22*a* can be transmitted to the lower end without being lost. Accordingly, when being fitted into the basal plate side connector, it becomes possible to press the pressing face 22*a* of the pressing part 22, so that the pressing power can act on sufficiently. No electric wires connected to the electric wire side connector that the holding parts 21 hold are present at the pressing face 22*a* of the pressing part 22, so that applying pressure to the pressing face 22*a* of the pressing part 22 can be easily performed. In addition, by structuring the pressing face 22*a* to have the plane surface, the pressing face 22*a* becomes easy to be handled even with the suction type hand of the robot.

At each surface of the pressing part 22 opposing to the holding parts 21 and each surface of the side wall parts 23 opposing to the holding parts 21, a positioning member 26 and a locking member 27 are provided; the positioning member 26 is formed in accordance with a shape of the electric wire side connector to be held; the locking member 27 is locked to the electric wire side connector that the holding parts 21 held.

The bottom face plates 24 positioned at each of the both sides in the array direction of the pressing part 22 has eighteen through holes 24*a* in two rows formed thereon. The eighteen through holes 24*a* in two rows are respectively formed at positions facing 2-rows-9-Pin cavities of two electric wire side connector held by the holding parts 21.

As shown in FIG. 4B and FIG. 4C, t four insertion holes 22*b* in two rows are formed at a lower end face of the pressing part 22; part of contactors of two rows of contactors of the basal plate side connector are inserted into the four insertion holes 22*b* in two rows. The t four insertion holes 22*b* in two rows and two of the eighteen through holes 24*a* in two rows (the cavities of the electric wire side connector) are arrayed in the same pitch with 2-rows-40-Pin contactors of the basal plate side connector. Thus, 2-rows-40-Pin general purpose products can be used as the basal plate side connector. Among the 2-rows-40-Pin contactors of the basal plate side connectors, the contactors that are to be inserted into the four insertion holes 22*b* in two rows of the pressing part 22 are originally assigned to contactors not to be used (unused contactors), and are only to be inserted into the insertion holes 22*b*.

Figure 5:
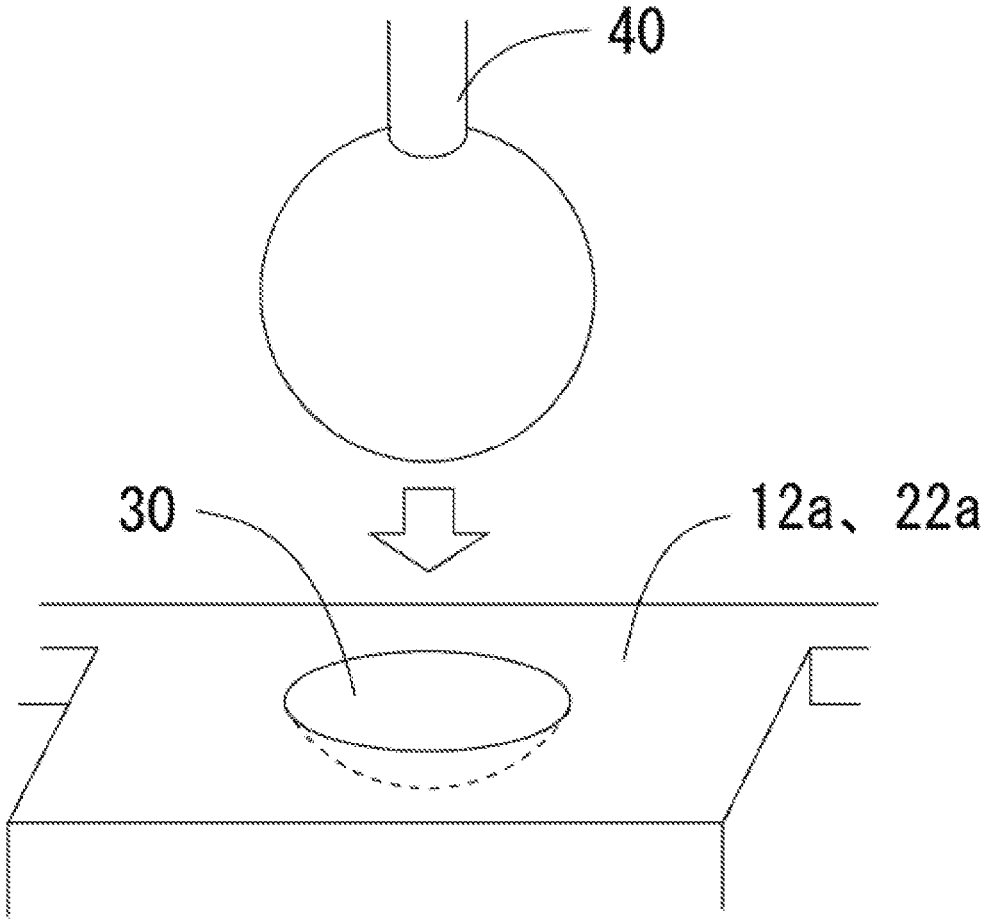
FIG. 5 is a view showing an example where a recessed portion is formed on a pressing face shown in FIG. 1 and FIG. 3.

In the above embodiments, the pressing faces 12*a*, 22*a* are formed of the plane surfaces. As shown in FIG. 5, however, the pressing faces 12*a*, 22*a* may have a recessed portion 30 formed thereon. The recessed portion 30 is formed in a shape where an end of a robot hand 40 that gives pressure to the pressing parts 12, 22 fits into. For example, as shown in FIG. 5, when an end of the robot hand 40 is a sphere, the recessed portion 30 is formed in a hemispherical or spherical shape. With this configuration, even if the position of the robot hand 40 is slightly shifted, the end of the robot hand 40 is guided to the recessed portion 30 by the tilt, making it possible for the robot hand 40 to apply the pressure to the pressing faces 12*a*, 22*a* at the precise position.

As described thus far, the above embodiments provide the connector holders 10, 20 that hold and integrate the plurality of electric wire side connectors, including: the pressing parts 12, 22 arranged in the center of the connector holder; the side wall parts 13, 23, respectively disposed on each of both sides with respect to the pressing parts 12, 22 at intervals in the array direction of pins of the connectors that the connector holders 10, 20; the bottom face plates 14, 24 that function as the connecting parts connecting the lower end portion of the pressing parts 12, 22 and each lower end portion of each side wall parts 13, 23 disposed on the both sides in the array direction. The holding parts 11, 21 are respectively formed on the both sides in the array direction of the pressing parts 12, 22, and the holding parts 11, 21 hold the electric wire side connector together with the pressing parts 12, 22, the side wall parts 13, 23, and the bottom face plates 14, 24. This configuration allows that the holding parts 11, 21 that hold the electric wire side connector are to be respectively arranged at the both sides in the array direction of the pressing parts 12, 22 arranged in the center, so that in a state of ensuring a space for pressing in the center, the plurality of electric wire side connectors can be held and integrated.

When the electric wire side connector becomes multipolarized, pressing is required when being fitted into the basal plate side connector. In the conventional technology, however, because there is the electric wire at the center of the connector, force is to be applied to the side portions of the connector upon insertion, and there is a problem that it cannot be pressed sufficiently.

Although there is no problem if a connector with a special specification having a space for applying pressure in the center part is used, a general-purpose connector cannot be used and the connector becomes expensive.

In contrast, in the present embodiment, it is possible to provide a connector holder which can hold and integrate a plurality of connectors in a state where a space for pressing the central portion is secured.

In the present embodiments, at the lower end faces of the pressing parts 12, 22, the insertion holes 12*b*, 22*b* into which part of the contactor of the plurality of contactors of the basal plate side connector, which is the mating side connector, are formed. The cavity of the electric wire side connector held by the holding parts 11, 21 and the insertion holes 12*b*, 22*b* of the lower end face of the pressing parts 12, 22 are arrayed in the same pitch with the contactors of the basal plate side connector. With this configuration, it becomes unnecessary to use the connector with the special specification as the basal plate side connector, and a general-purpose product becomes usable.

The upper end faces of the pressing parts 12, 22 are formed into the plane perpendicular to the fitting direction, and function as the pressing faces 12*a*, 22*a*. With this configuration, it is possible to operate sufficient pressing power.

In the present embodiments, the upper end faces of the pressing parts 12, 22 are formed with the recessed portion 30 into which the tip of the robot hand 40 pressing the pressing parts 12, 22 is fitted. With this configuration, even if the position of the robot hand 40 is slightly shifted, the end of the robot hand 40 is guided to the recessed portion 30 by the tilt, making it possible for the robot hand 40 to apply the pressure, at the precise position, to the pressing faces 12*a*, 22*a*.

In the present embodiments, the bottom face plates 14, 24, which are plate-like members, are formed with the through holes 14*a*, 24*a* at a position facing each of the cavities of the electric wire side connector held by the holding parts 11, 21. With this configuration, the contactors of the basal plate side connector can be led to the cavity of the electric wire side connector.

In the present embodiments, the holding parts 21 have structure of holding two electric wire side connectors in the orthogonal direction of the array direction that is the direction orthogonal with the array direction. With this configuration, it is possible to configure the electric wire side connector to be fitted to the basal plate side connector of a plurality of pins in two rows.

The present embodiments include the connecting bar 25*s* that connect the center portion in the orthogonal direction of the array direction on the upper end portion of the pressing part 22 and the center portion in the orthogonal direction of the array direction on each upper end portion of each of the side wall parts 23 disposed on the both sides in the array direction. With this configuration, even in the case of structuring the electric wire side connector that fits into the basal plate side connector having the plurality of pins in two rows, strength of the holding parts 21 can be ensured by simple configuration.

The present disclosure is not limited to the embodiments described above and it is clear that various modifications thereto can be made. The number, position, shape, and so on of the above-mentioned constituent members are not limited to the above-mentioned embodiments, but can be made the number, position, shape, and so on suitable for carrying out the present disclosure. In each of the drawings, similar structural elements are given the same numerals.

Further, the configurations and processes of the embodiments described with reference to FIGS. 1 to 5 are merely exemplary, and not intended to limit the configurations and processes.

While the present disclosure has been described in detail with reference to the embodiments thereof, it would be apparent to those skilled in the art the various changes and modifications may be made therein within the scope defined by the appended claims.

What is claimed is:

1. A connector holder that holds and integrates a plurality of connectors, the connector holder comprising:

a pressing part arranged in a center of the connector holder;

side wall parts respectively disposed on each of both sides with respect to the pressing part at intervals in an array direction of pins of the connectors that the connector holder holds; and connecting parts that respectively connect a lower end portion of the pressing part and a lower end portion of each of the side wall parts disposed on the both sides in the array direction, wherein holding parts are respectively formed on the both sides in the array direction of the pressing part, the holding parts holding the connectors together with the pressing part, the side wall parts, and the connecting parts, and an upper end face of the pressing part is formed with a recessed portion to which a tip of a robot hand that presses the pressing part is to be fitted.

2. The connector holder according to claim 1, wherein insertion holes, into which part of a plurality of contactors of a mating side connector are to be inserted, are formed on a lower end face of the pressing part, and cavities of the connectors held by the holding parts and the insertion holes formed on the lower end face of the pressing part are arrayed in the same pitch with the plurality of contactors of the mating side connector.

3. The connector holder according to claim 2, wherein contactors being part of the plurality of contactors of the mating side connector and being unused are inserted into the insertion holes formed on the lower end face of the pressing part.

4. The connector holder according to claim 1, wherein an upper end face of the pressing part is formed into a plane perpendicular to a fitting direction, and functions as a pressing face.

5. The connector holder according to claim 1, wherein the connecting parts are plate-like members where through holes are respectively formed at positions facing cavities of the connectors held by the holding parts.

6. The connector holder according to claim 1 further comprises connecting bars that respectively connect an upper end portion of the pressing part and an upper end portion of each of the side wall parts disposed on the both sides in the array direction.

7. The connector holder according to claim 1, wherein the holding parts have a structure of holding two of the connectors in an orthogonal direction of the array direction that is a direction orthogonal with the array direction.

8. The connector holder according to claim 7 further comprises connecting bars that respectively connect a center portion in the orthogonal direction of the array direction on the upper end portion of the pressing part and a center portion in the orthogonal direction of the array direction on an upper end portion of each of the side wall parts disposed on the both sides in the array direction.

* * * * *